US006286448B1

(12) United States Patent
Sahr et al.

(10) Patent No.: US 6,286,448 B1
(45) Date of Patent: Sep. 11, 2001

(54) BOAT AND METHOD FOR MANUFACTURING

(75) Inventors: Ronald C. Sahr, Randall; Bradley James Brown, Hillman; Jerry Lee Johnson, Little Falls, all of MN (US)

(73) Assignee: Larson Glastron, Little Falls, MN (US)

( * ) Notice: Subject to any disclaimer, the term of this patent is extended or adjusted under 35 U.S.C. 154(b) by 0 days.

(21) Appl. No.: 09/396,845

(22) Filed: Sep. 15, 1999

(51) Int. Cl.[7] ..... B63B 5/24
(52) U.S. Cl. ..... 114/357
(58) Field of Search ..... 114/355, 357, 114/65 R

(56) References Cited

U.S. PATENT DOCUMENTS

| | | | | |
|---|---|---|---|---|
| 2,909,791 | * | 10/1959 | Malary, Jr. | 114/357 |
| 3,840,926 | * | 10/1974 | Stoeberl | 114/357 |
| 3,848,284 | * | 11/1974 | Livingston | 114/357 |
| 4,214,332 | | 7/1980 | Stoner . | |
| 4,719,871 | | 1/1988 | Fantacci et al. . | |
| 4,778,420 | | 10/1988 | Greenberg . | |
| 5,035,602 | | 7/1991 | Johnson . | |
| 5,036,790 | | 8/1991 | Berryer . | |
| 5,045,251 | | 9/1991 | Johnson . | |
| 5,063,870 | * | 11/1991 | Wagner | 114/357 |
| 5,069,414 | | 12/1991 | Smith . | |
| 5,458,844 | | 10/1995 | MacDougall . | |
| 5,875,731 | | 3/1999 | Abernethy et al. . | |

* cited by examiner

*Primary Examiner*—Ed Swinehart
(74) *Attorney, Agent, or Firm*—Merchant & Gould P.C.

(57) ABSTRACT

The present disclosure relates to a boat including a hull having an interior region. The boat also includes an insert mounted within the hull. The insert includes a bottom piece having a bottom side that complements and nests within the interior region of the hull. The insert also includes a top piece secured to the bottom piece. The top and bottom pieces cooperate to define an inner foam chamber. The insert further includes a volume of foam positioned within the foam chamber.

16 Claims, 6 Drawing Sheets

BOAT AND METHOD FOR MANUFACTURING

FIELD OF THE INVENTION

The present invention relates generally to boats. More particularly, the present invention relates to boats having fiberglass hulls and to methods for manufacturing such boats.

BACKGROUND OF THE INVENTION

Boat hulls have historically been made of many different types of material such as aluminum, steel or wood. Another common material used in the manufacture of boat hulls is a laminate material made of fiberglass-reinforced resin.

Open face molds are frequently used to manufacture fiberglass hulls. To make a hull with an open face mold, a layer of gel coat is frequently first applied to the mold. Next, a barrier layer is often applied to the gel coat. Finally a layer of fiberglass-reinforced resin is applied to the barrier layer. When the hull is removed from the mold, the gel coat provides a smooth, aesthetically pleasing outer surface of the hull. The barrier layer prevents the fiberglass from printing or pressing through the gel coat. The fiberglass provides the hull with structural rigidity.

With fiberglass boats, it is often desirable to inject foam into foam compartments formed within the boats. The injection of foam presents several problems. For example, when foam is injected into a boat, pressure generated by the foam injection process can cause portions of the boat to bow or buckle outward thereby negatively affecting the appearance and structural integrity of the boat. This can be particularly problematic with respect to unsupported parts manufactured by injection molding or resin transfer molding operations. Also, to access foam chambers within a boat, it is often necessary to drill holes through portions of the boat. This is problematic because the drilling of holes can cause the aesthetically pleasing outer gel coat surface to be damaged. The repair of such damage can be time consuming.

SUMMARY OF THE INVENTION

One aspect of the present invention relates to a boat including a hull having an interior region. The boat also includes an insert mounted within the hull. The insert includes a bottom piece having a bottom side that complements and nests within the interior region of the hull. The insert also includes a top piece secured to the bottom piece. The top and bottom pieces cooperate to define an inner foam chamber. The insert further includes a volume of foam positioned within the foam chamber.

Another aspect of the present invention relates to a method for manufacturing a boat. The method includes providing a hull. The method also includes providing an insert having a top piece and a bottom piece that cooperate to define a foam chamber. The method further includes injecting foam into the foam chamber of the insert, and securing the insert within the hull.

A further aspect of the present invention relates to a method for making a boat including providing a boat structure including a hull and a deck, supporting the boat structure between at least two mold pieces, and injecting foam into a foam chamber defined within the boat structure. The foam is injected in the foam chamber while the boat structure is concurrently supported by the at least two mold pieces.

A variety of advantages of the invention will be set forth in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several aspects of the invention and together with the description, serve to explain the principles of the invention. A brief description of the drawings is as follows.

DETAILED DESCRIPTION

Reference will now be made in detail to exemplary aspects of the present invention that are illustrated in the accompanying drawings. Wherever possible, the same reference numbers will be used throughout the drawings to refer to the same or like parts.

Figure 1:
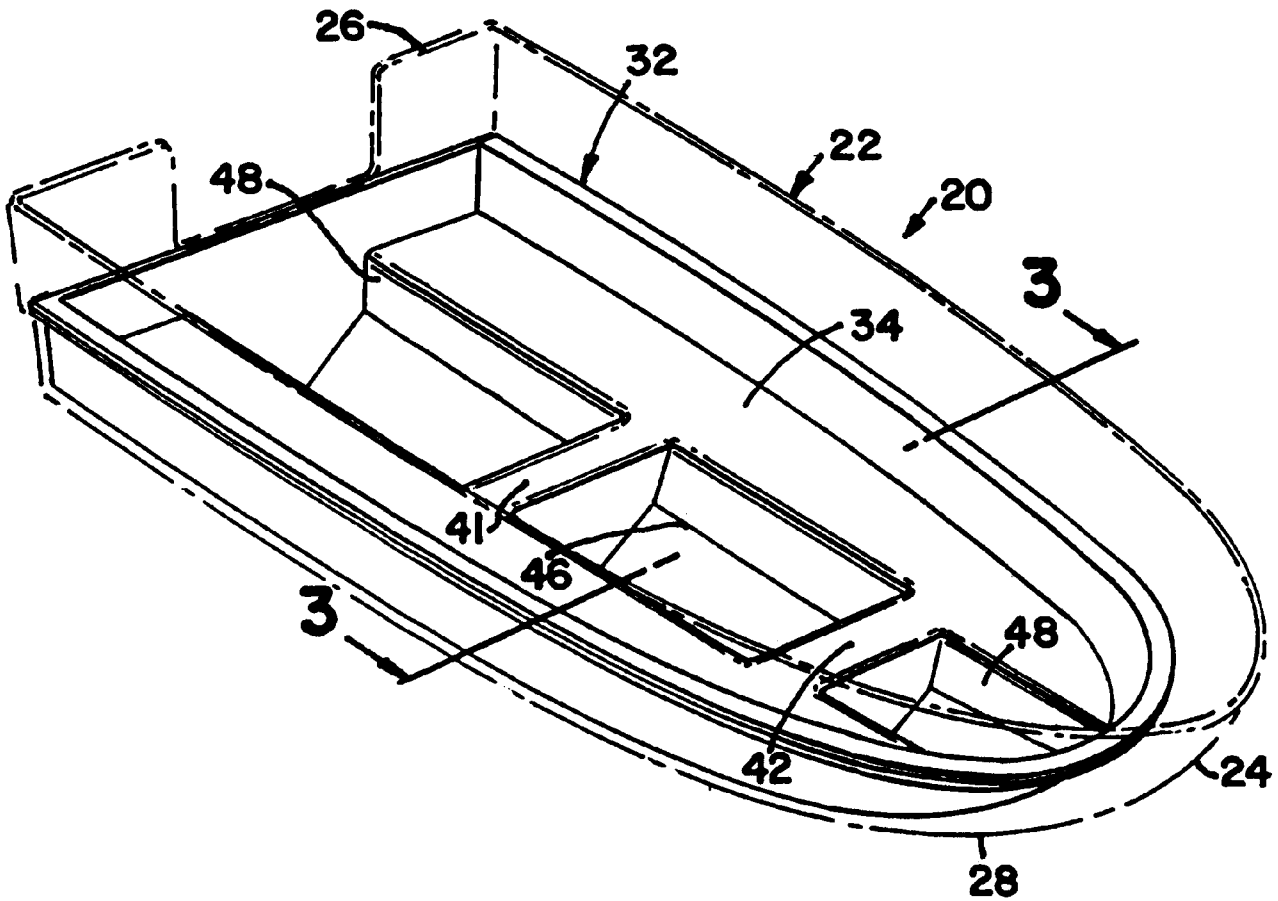
FIG. 1 is a perspective view of a boat constructed in accordance with the principles of the present invention.
Figure 2:
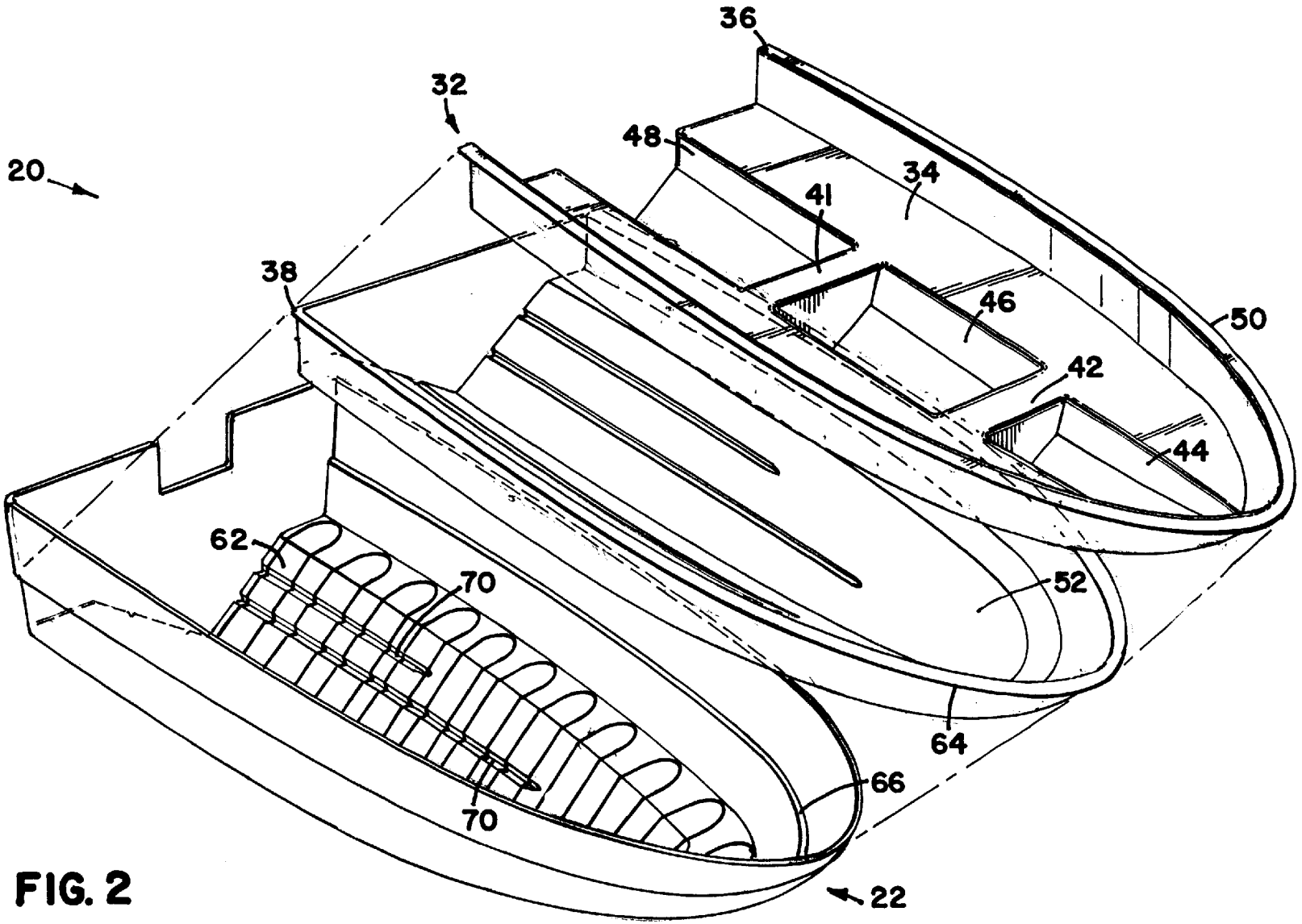
FIG. 2 is an exploded, perspective view of the boat of FIG. 1.

FIG. 1 is a perspective view of a boat 20 constructed in accordance with the principles of the present invention. The boat 20 includes a hull 22 (shown in phantom line) including a bow 24 positioned opposite from a stern 26. A keel 28 extends between the bow 24 and the stern 26. Chines 30 and strakes 27 (best shown in FIG. 3) are located on port and starboard sides of the hull 22. The boat 20 also includes a pan or insert 32 mounted within the hull 22. The insert 32 provides structural rigidity or reinforcement to the hull 22. As shown in FIG. 2, the insert 32 is formed by a top piece 36 and a bottom piece 38.

The top piece 36 of the insert 32 includes a generally planar, horizontal top surface that forms an upper deck or platform 34 of the boat 22. The top piece 36 also includes first and second supports 41 and 42. The supports 41 and 42 extend widthwise across the top piece 36 and are configured for providing structural reinforcement to the hull 22. The top piece 36 further includes an upper lip or flange 50. The flange 50 projects transversely outward from the top edge of the top piece 36, and extends generally about a perimeter of the top piece 36.

Still referring to FIG. 2, the top piece 36 also defines a plurality of internal compartments. For example, the top piece 36 defines a front storage compartment 44 positioned in front of the second support 42, a middle fuel-tank compartment 46 positioned between the first and second supports 41 and 42, and a rear engine compartment 48 positioned behind the first support 41. The front and middle compartments 44 and 46 preferably can be covered with removable panels (not shown).

Figure 3:
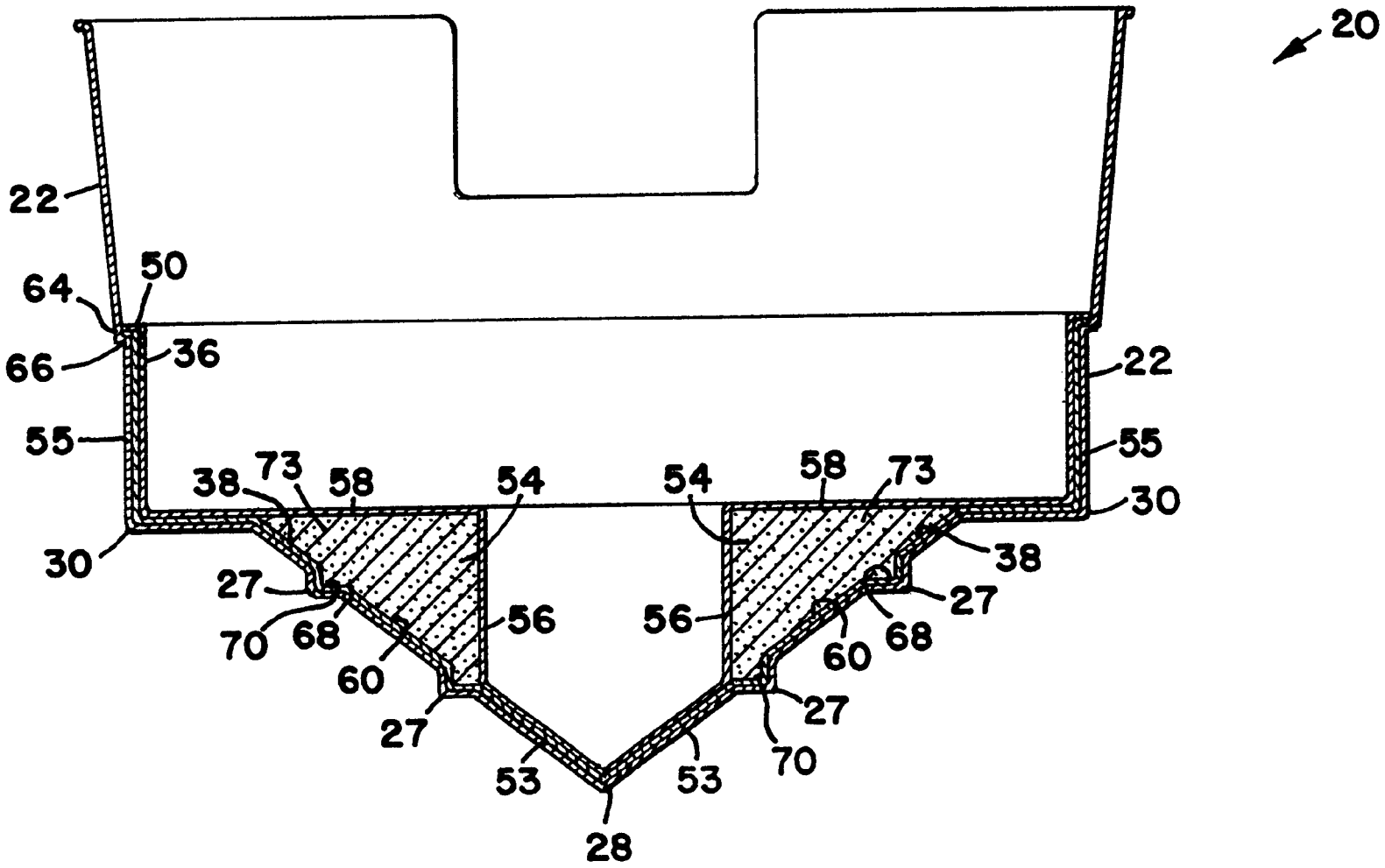
FIG. 3 is a cross-sectional view taken along section line 3—3 of FIG. 1.

Referring again to FIG. 2, the bottom piece 38 of the insert 32 includes an interior region 52 sized for receiving the top piece 36. The interior region 52 is configured to generally complement a bottom profile of the top piece 36 such that the top piece 36 can nest within the interior region 52. FIG. 3 shows the top piece 36 nested within the bottom piece 38. As so nested, keel regions 53 of the top and bottom pieces 36 and 38 engage one another in a parallel relationship. Additionally, chine regions 55 of the top and bottom pieces 36 and 38 engage one another in a parallel relationship. In the keel and chine 53 and 55 regions, no substantial gap exists between the top and bottom pieces 36 and 38. By contrast, between the keel and chine regions 53 and 55, the top and bottom pieces 36 and 38 separate from one another so as to define foam chambers 54 having generally triangular cross-sections. As shown in FIG. 3, each foam chamber 54 is defined by an upright wall 56 of the top piece 36, a horizontal wall 58 of the top piece 36, and an inclined wall 60 of the bottom piece 38. Each foam chamber 54 is filled with a volume of foam 73.

A bottom side or bottom profile of the bottom piece 38 is configured to complement and nest within an interior region 62 (best shown in FIG. 2) of the hull 22. When nested within the hull 22 as shown in FIG. 3, substantially the entire bottom surface of the bottom piece 38 makes generally parallel contact with the interior region 62 of the hull 22. Also, a top flange 64 that extends about the perimeter of the bottom piece 38 seats upon a shoulder 66 defined by the interior region 62 of the hull 22. Further, a plurality of strake projections 68 formed on the bottom of the bottom piece 38 fit within complementary strake recesses 70 formed along the interior region 62 of the hull 22.

It is preferred for the top piece 36 to be manufactured by an open face molding process. To practice such a process, a layer of gel coat (e.g., about 0.020–0.024 inches thick) is first applied to an open face mold. Next, a layer of reinforcing chop material and resin (e.g., about 0.090–0.100 inches thick) is applied over the gel coat. For example, fiberglass can be applied by blowing a mixture of resin and fiberglass chop strand onto the gel coat layer to form a wet laminate layer. The wet laminate layer is then rolled out, and reinforcements can be laid within the wet laminate material. Exemplary types of reinforcements include aluminum plates/members for mounting seats, coremat for preventing the seat mounts from printing through the fiberglass laminate, and wood reinforcements for providing a motor mount and for providing a tank cover and storage lid hold-down function. Upon curing, the laminate preferably has a thickness of about 0.100 inches and forms a generally rigid shell containing the reinforcements.

While it is preferred to use an open face molding process, it will be appreciated that the top piece 36 can be manufactured by any number of known techniques. For example, the top piece 36 can be manufactured by a resin transfer molding process, an injection molding process, or any other known technique. U.S. application Ser. No. 08/715,533 filed on Sep. 18, 1996 and entitled Apparatus For Molding Composite Articles, which is hereby incorporated by reference, discloses an exemplary resin transfer molding process. It will also be appreciated that the hull 22 and the bottom piece 38 can be manufactured by techniques similar to those described with respect to the top piece 36. For example, in one particular embodiment, the bottom piece 38 can be manufactured by an open face molding process in which a fiberglass laminate is applied to an open face mold. In such an embodiment, no gel coat layer, barrier layer or reinforcements are used, and the bottom piece 38 can have a laminate thickness of about 0.06 inches.

In one particular non-limiting embodiment of the hull 22, the hull has an outer gel coat layer of about 0.024 inches, and intermediate barrier layer of about 0.035 inches, and an inner fiberglass layer of about 0.25–0.375 inches. The barrier layer prevents the fiberglass from pressing through the gel coat.

To assemble the insert 32, a layer of adhesive (e.g., a polyester putty) is preferably spread either along the bottom surface of the flange 50, or along the top surface of the flange 64. At the time the adhesive is applied, the top piece 36 is preferably supported by a first open face mold 72 (shown in FIG. 4) and the bottom piece 38 is supported by a second open face mold 74 (shown in FIG. 4). While supported by their corresponding open faced molds 72 and 74, the top piece 36 is placed or nested within the interior region 52 of the bottom piece 38. As so positioned, the first and second open faced molds 72 and 74 are clamped together thereby compressing the adhesive between the flanges 50 and 64.

With the two open face molds 72 and 74 clamped together, foam 73 (e.g., a polyurethane loam that becomes generally rigid upon curing) is preferably injected into the foam chambers 54. Preferably, the foam 73 is injected through 10 to 12 holes that have been pre-drilled through either the bottom piece 38 or the top piece 36. During the injection process, the open face molds 72 and 74 prevent the top and bottom pieces 36 and 38 from bowing or buckling away from one another. Consequently, the molds 72 and 74 assist in improving the aesthetic appearance and design tolerance of the insert 32.

Figure 4:
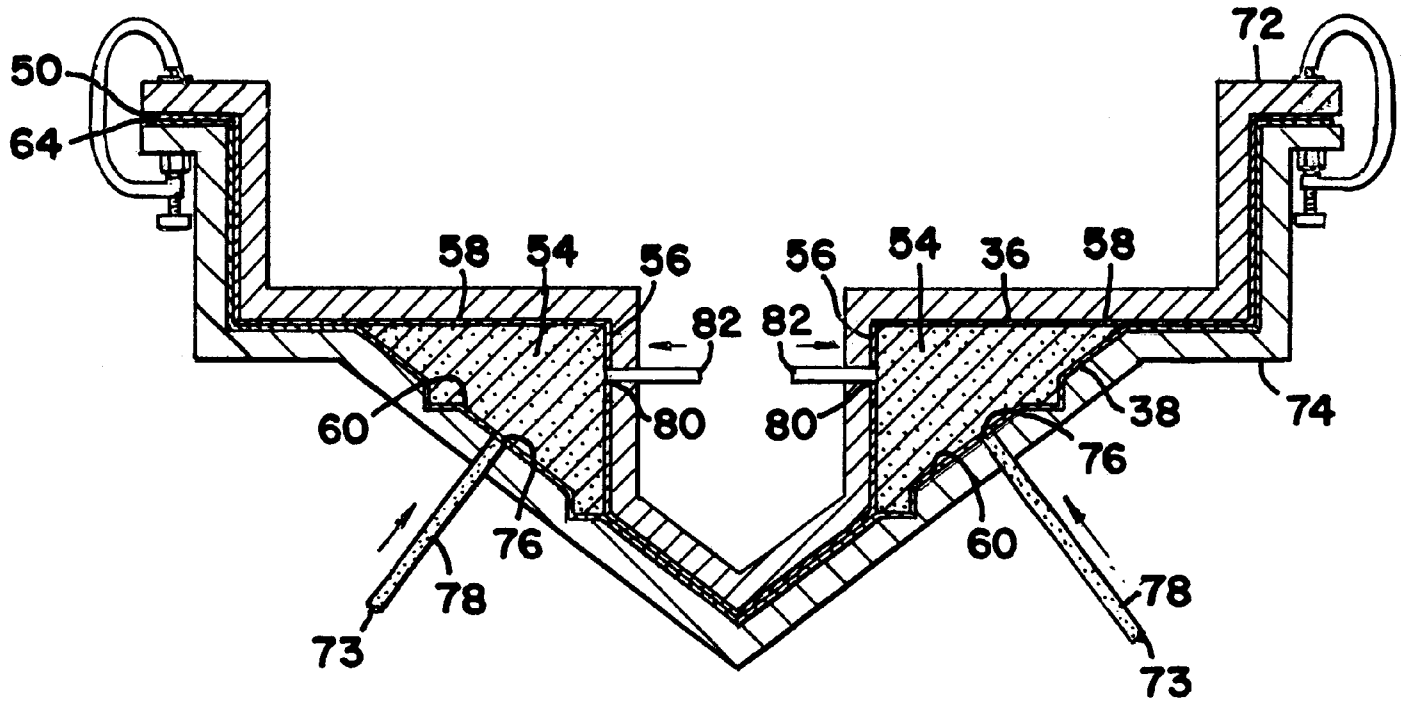
FIG. 4 is a cross-sectional view of an insert used in the boat of FIG. 1, the insert is shown supported between top and bottom molds.

Referring to FIG. 4, the pre-drilled holes have been located in two different locations. For example, a first set of pre-drilled holes 76 have been drilled through the inclined walls 60 of the bottom piece 38. The first set of holes 76 are in fluid communication with the foam chambers 54. Nozzles or conduits 78 that extend through the second open face mold 74 are used to inject the foam into the foam chambers 54 through the first set of openings 76.

A second set of openings 80 have been pre-drilled through the upright walls 56 of the top piece 36. Similar to the openings 76, the openings 80 are in fluid communication with the foam chambers 54. Nozzles or conduits 82 that extend through the first open face mold 72 are used to inject foam into the foam chambers 54 through the second set of openings 80.

The locations of the first and second sets 76 and 80 of openings are advantageous because such openings are located at inconspicuous positions. Consequently, it is not necessary to refinish these regions after the injection molding process. By contrast, the horizontal, top wall 58 of the top piece 36 forms the platform 34 of the boat 22. Holes through this region would be highly visible and would damage the outer gel coat finish. Consequently, holes through the horizontal, top wall 58 would most likely necessitate refinishing of the top surface 40 of the top piece 36.

After the foam 73 has cured within the foam chambers 54, the insert 32 is removed from the open face molds 72 and 74, and is inserted into the interior region 62 of the hull 22. An adhesive material (e.g., an adhesive sold by Applied Products, Inc. under the name Plexus) is preferably used to secure the insert 32 within the hull 22. A solvent can be used to prepare or clean the surface of the hull prior to applying the adhesive.

Figure 5:
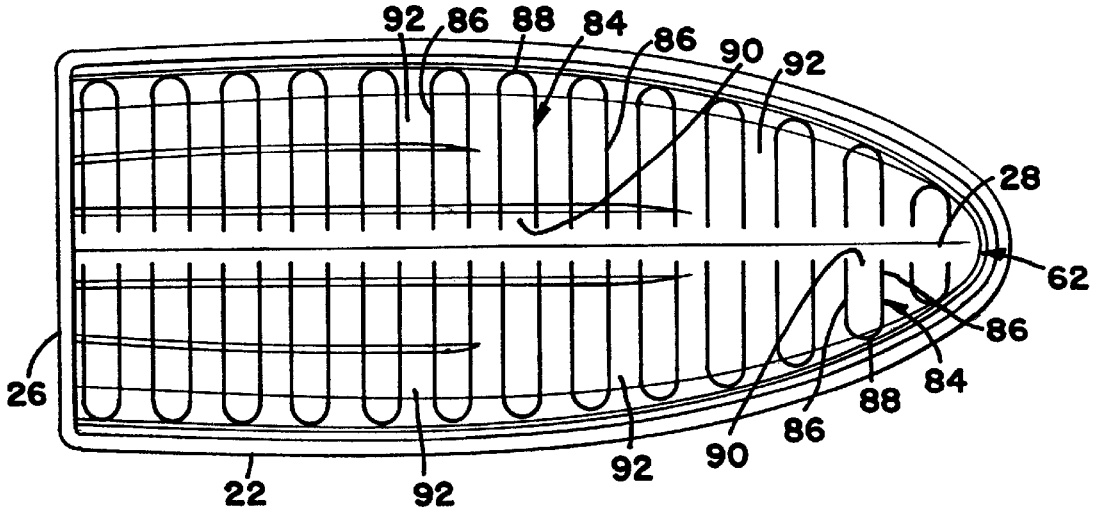
FIG. 5 is a plan view illustrating an adhesive pattern used in the hull of the boat of FIG. 1.

As shown in FIG. 5, a plurality of beads 84 of adhesive are applied to the interior region 62 of the hull 22 prior to inserting the insert 32 therein. When the insert 32 is inserted within the hull 22, an adhesive bond is formed between the hull 22 and the bottom surface of the bottom piece 38.

The beads 84 of adhesive are preferably arranged in a pattern for allowing water to drain between the hull 22 and the bottom piece 38. Each bead 84 is generally U-shaped and includes two legs 86 that are generally perpendicular with respect to the keel 28. Rounded ends 88 of the beads 84 are located adjacent the port and starboard sides of the hull 22. Open ends 90 of the beads 84 are located adjacent to the keel 28 of the hull 22. The legs 86 of the beads are aligned generally parallel to one another. Flow passageways 92 are defined between each of the beads 84. The flow passageways 92 allow water to drain along the interior region 62 of the hull 22 from the chines 30 toward the keel 22. A drainage opening (not shown) is preferably located at the keel 28 adjacent to the stern 26 for allowing water to drain from the hull 22. The particular configuration of the adhesive beads 84 is advantageous because it prevents water from being captured or otherwise retained between the insert 32 and the hull 22. Retained water is problematic because at cold temperatures the water can freeze and cause cracking of the hull 22.

In addition to the U-shaped beads 84 of adhesive, a layer of adhesive can also be applied about the shoulder 66 of the hull 22. This adhesive extends about the perimeter of the bottom piece 38 of the insert 32, and forms a sealed bond between the bottom side of the flange 64 and the top side of the shoulder 66.

Figure 6:
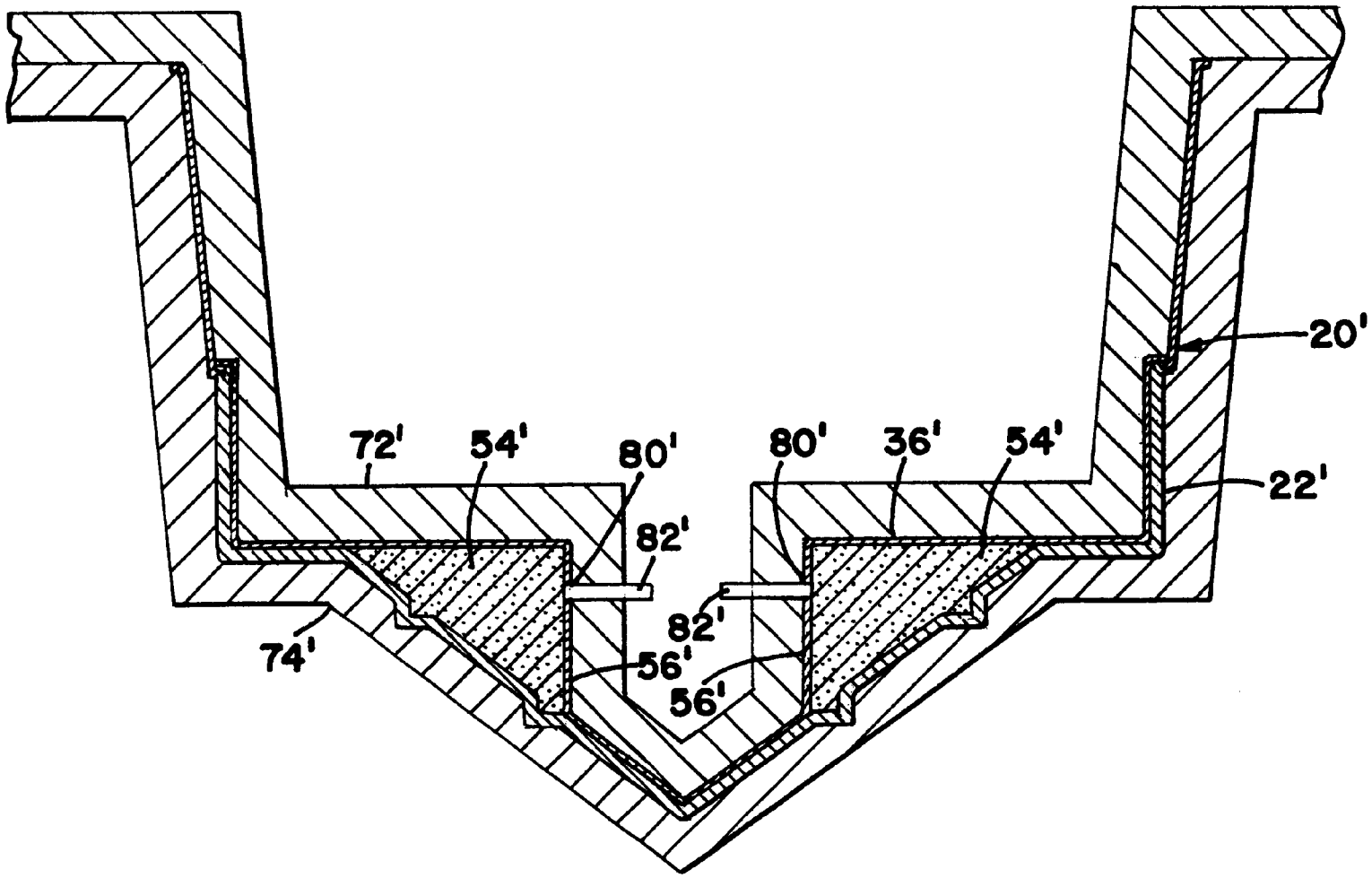
FIG. 6 is a cross-sectional view of an alternative boat in the process of having foam injected within a foam chamber of the boat.

FIG. 6 is a cross sectional view of an alternative boat 20' constructed in accordance with the principles of the present invention. The boat 20' is in the process of being injected with foam. Parts similar to those previously described with respect to the embodiment of FIGS. 1–5 will be assigned like numbers with the addition of apostrophes to distinguish the embodiments.

The boat 20' has a similar configuration as the boat 20, except the bottom piece 38 of the insert 32 has been eliminated. Instead, a one-piece insert 36' is mounted within a hull 22' of the boat 20'. Foam chambers 54' are defined between the insert 36' and the hull 22'.

As shown in FIG. 6, the insert 36' is supported within a first open mold 72' and the hull 22' is supported in a second open mold 74'. The open molds 72' and 74' are clamped together such that the boat 20' is contained between the molds 72' and 74'.

A set of openings 80' have been pre-drilled through upright walls 56' of the insert piece 36'. The openings 80' are in fluid communication with the foam chambers 54'. Nozzles or conduits 82' that extend through the first open face mold 72' are used to inject foam into the foam chambers 54' through the second set of openings 80'.

With regard to the foregoing description, it is to be understood that changes may be made in detail, especially in matters of the construction materials employed and the shape, size and arrangement of the parts without departing from the scope of the present invention. It is intended that the specification and depicted aspects be considered exemplary only, with a true scope and spirit of the invention being indicated by the broad meaning of the following claims.

What is claimed is:

1. A boat comprising:

a) a hull having an interior region, keel and chines; and b) an insert mounted within the hull, the insert including:

i) a bottom piece including a bottom side that complements and nests within the interior region of the hull, wherein the bottom piece of the insert is affixed to the hull by adhesive, the adhesive being arranged in a pattern configured for allowing water to drain along the interior region of the hull from the chines to the keel and wherein the pattern includes a plurality of beads having portions that are parallel to one another and transverse with respect to the keel;

ii) a top piece secured to the bottom piece, the top and bottom pieces cooperating to define an inner foam chamber; and iii) a volume of foam positioned within the foam chamber.

2. The boat of claim 1, wherein the bottom side of the bottom piece defines a plurality of openings for allowing the foam to be injected into the foam chamber.

3. The boat of claim 1, wherein the top piece includes an upright wall defining a plurality of openings for allowing the foam to be injected into the foam chamber.

4. The boat of claim 1, wherein the bottom side of the bottom piece includes strakes that fit within complementary strake recesses that extend along the interior region of the hull.

5. A method for manufacturing a boat comprising:

providing a hull, the hull comprising a bow region and a stern region;

providing an insert sized to extend from the bow region to the stern region and having a top piece and a bottom piece, wherein the top and bottom pieces include keel regions that engage one another in a parallel relationship and chine regions that engage one another in parallel relationship, the top and bottom pieces separating from one another between the chine and keel regions to define foam chambers;

injecting foam into the foam chambers of the insert; and securing the insert within the hull.

6. The method of claim 5, wherein the insert is secured within the hull after the foam chamber has been filled with foam.

7. The method of claim 5, wherein the foam is injected through a hole defined by the bottom piece.

8. The method of claim 5, wherein the bottom piece mates with the hull.

9. The method of claim 5, wherein the top piece includes a top surface and an upright wall aligned generally transversely with respect to the top surface, and wherein the foam is injected through a hole defined by the upright wall of the top piece.

10. The method of claim 5, wherein the foam is injected into the foam chamber while the insert is enclosed and supported between two mold pieces.

11. The method of claim 10, wherein the mold pieces include passageways for directing the foam through the molds and into the foam chamber of the insert.

12. The method of claim 5, wherein a bottom side of the bottom piece includes strakes that fit within complementary strake recesses that extend along an interior region of the hull.

13. The method of claim 5, wherein the top piece includes a top wall that forms an upper platform of the boat.

14. The method of claim 5, wherein the insert piece includes a top outwardly projecting lip that extends about a majority of a perimeter of the insert piece and seats on a corresponding shoulder defined by an interior region of the hull.

15. A method for making a boat comprising:

providing a boat structure including a hull and a deck, wherein the deck is formed by an insert piece including a top surface and an upright wall aligned transversely with respect to the top surface;

supporting the boat structure between at least two mold pieces; and injecting foam into a foam chamber defined within the boat structure through a hole defined by the upright wall while the boat structure is concurrently supported by the at least two mold pieces.

16. The method of claim 15, wherein the foam is injected through at least one of the at least two mold pieces.

* * * * *